US007464819B2

(12) United States Patent
Maietta

(10) Patent No.: US 7,464,819 B2
(45) **Date of Patent: *Dec. 16, 2008**

(54) CHILD-RESISTANT CONTAINER

(75) Inventor: Michael G. Maietta, Logan Station, PA (US)

(73) Assignee: West Pharmaceutical Services, Inc., Lionville, PA (US)

( * ) Notice: Subject to any disclaimer, the term of this patent is extended or adjusted under 35 U.S.C. 154(b) by 182 days.

This patent is subject to a terminal disclaimer.

(21) Appl. No.: 10/941,588

(22) Filed: Sep. 14, 2004

(65) Prior Publication Data

US 2005/0115862 A1 Jun. 2, 2005

Related U.S. Application Data

(63) Continuation-in-part of application No. 10/308,335, filed on Dec. 2, 2002, now Pat. No. 6,789,677.

(60) Provisional application No. 60/334,409, filed on Nov. 30, 2001.

(51) Int. Cl.

| | |
|---|---|
| ***B65D 43/16*** | (2006.01) |
| ***B65D 85/42*** | (2006.01) |
| ***B65D 83/04*** | (2006.01) |
| ***A45C 13/10*** | (2006.01) |

(52) U.S. Cl. ..... 206/536; 206/528; 206/538; 206/1.5

(58) Field of Classification Search ..... 206/528–540, 206/534.1, 534.2, 1.5, 37, 38, 39.4, 39.5; 220/281, 283, 820, 823, 824; 292/332–336, 292/1; 70/63, 159, 289, 313; 312/107.5, 312/120, 123, 126

See application file for complete search history.

(56) References Cited

U.S. PATENT DOCUMENTS

| | | | | |
|---|---|---|---|---|
| 405,003 | A * | 6/1889 | Blackledge | 312/123 |
| 1,455,432 | A | 5/1923 | Dodson | |
| 1,460,950 | A | 7/1923 | Denney | |
| 1,910,033 | A | 5/1933 | Mincovsky | |
| 2,327,513 | A | 8/1943 | Esterow | |
| 2,391,347 | A | 12/1945 | Punte | |
| 3,504,788 | A | 4/1970 | Gray | |

(Continued)

FOREIGN PATENT DOCUMENTS

| | | |
|---|---|---|
| DE | 38 32 050 A1 | 3/1990 |

(Continued)

*Primary Examiner*—J. Gregory Pickett
(74) *Attorney, Agent, or Firm*—Panitch Schwarze Belisario & Nadel LLP

(57) ABSTRACT

A child-resistant container for holding at least one item includes a housing having upper and lower walls and a first tray pivotally mounted to the housing on a pivot axis. The first tray is pivotable between a retracted position in which the first tray is positioned in the housing and an exposed position in which the first tray extends from the housing. A second tray is pivotally mounted to the housing for movement between a retracted position in which the second tray is positioned in the housing and an exposed position in which the second tray extends from the housing. The first and second trays are adapted for holding the at least item. A common locking mechanism engages the first and second trays to releasably lock the first and second trays in the retracted position.

18 Claims, 9 Drawing Sheets

U.S. PATENT DOCUMENTS

| | | | | | |
|---|---|---|---|---|---|
| 3,526,351 | A | | 9/1970 | Goldstein | |
| 3,894,654 | A | | 7/1975 | Frankenberg | |
| 4,511,032 | A | | 4/1985 | Bush | |
| 4,561,544 | A | | 12/1985 | Reeve | |
| 4,730,731 | A | | 3/1988 | Allison | |
| 4,741,433 | A | | 5/1988 | Irvine | |
| 4,875,743 | A | * | 10/1989 | Gelardi et al. | 206/308.1 |
| 4,915,256 | A | * | 4/1990 | Tump | 206/534 |
| 5,244,084 | A | | 9/1993 | Chan | |
| 5,402,515 | A | * | 3/1995 | Vidacovich et al. | 385/135 |
| 5,413,219 | A | | 5/1995 | Yu | |
| 5,632,394 | A | | 5/1997 | Mecca et al. | |
| 5,785,180 | A | | 7/1998 | Dressel et al. | |
| 5,878,887 | A | | 3/1999 | Parker et al. | |
| 6,021,901 | A | | 2/2000 | Wolfe | |
| 6,036,018 | A | * | 3/2000 | Harrold | 206/536 |
| 6,041,935 | A | | 3/2000 | Yang | |
| 6,247,595 | B1 | | 6/2001 | Omata et al. | |
| 6,263,141 | B1 | * | 7/2001 | Smith | 385/135 |
| 6,302,120 | B1 | | 10/2001 | Kuo | |
| 6,318,550 | B1 | | 11/2001 | Giovinazzi | |
| 6,325,241 | B1 | | 12/2001 | Garde et al. | |
| 6,345,627 | B1 | | 2/2002 | Petit | |
| 6,679,381 | B1 | * | 1/2004 | Bush | 206/531 |
| 6,789,677 | B2 | | 9/2004 | Maietta | |
| 2004/0108322 | A1 | * | 6/2004 | Maietta et al. | 221/2 |

FOREIGN PATENT DOCUMENTS

| | | |
|---|---|---|
| DE | 201 09 659 | 8/2001 |
| EP | 1 0888 769 | 1/2005 |

* cited by examiner

CHILD-RESISTANT CONTAINER

CROSS-REFERENCE TO RELATED APPLICATIONS

This application is a continuation-in-part application of U.S. patent application Ser. No. 10/308,335, filed Dec. 2, 2002 now U.S. Pat. No. 6,789,677 and claims priority from U.S. Provisional Patent Application No. 60/334,409, filed Nov. 30, 2001, entitled "Child-resistant Container".

BACKGROUND OF THE INVENTION

The present invention relates to a child-resistant container and more specifically to a child-resistant container for storing a blister pack having an arrangement of blisters each of which contains a tablet or capsule.

Many pharmaceutical products such as tablets and capsules are packaged in blister packs to deter children from obtaining and ingesting the products, to provide a small quantity of medication in a cost effective package and to allow for compliance throughout the medication cycle. In addition, the blister packs are commonly utilized as physician samples for specific drugs and are not always packaged in a child-resistant package/container. The designer of such blister packs is confronted with conflicting requirements. The blister pack should be child-resistant and at the same time able to be opened without unreasonable difficulty. Typical blister packs are known to be difficult for some adults to open while still failing to be a deterrent for unsupervised children. In addition, blister packs are often utilized to help users keep track of their daily dosage of medication, which is taken over long periods of time. Storage of multiple blister packs in a single location aids a patient in remembering to take their medication each day over the months and years that the patient may need the medication.

A child-resistant container for storing blister packs provides a second layer of safety. To be effective the container should require a degree of perception and manual dexterity above the abilities of unsupervised children attempting to gain access to the contents of the blister pack and should also be easy for adults to use. A container requiring the coordinated use of both hands and the simultaneous application of a force to both a latch and a lock assembly to gain access to the blister pack, such as the container of the invention disclosed herein, should provide the requisite level of protection.

A container that is able to conveniently store multiple blister packs that also present a convenient tool for a patient to remember to take their medication over numerous months and years is also disclosed herein. The container may include a number of trays that require the coordinated use of both hands to open and store a plurality of blister packs corresponding to multiple days, months or years worth of medication for a patient.

BRIEF SUMMARY OF THE INVENTION

In accordance with one aspect of the invention, a child-resistant container for holding at least one item includes a housing having upper and lower walls and at least one open side between the upper and lower walls and a tray that is pivotably connected to the housing at a pivot joint. The tray is adapted for holding at least one item and is pivotable between a first position in which the tray is in the housing for preventing access to the at least one item and a second position in which the tray extends through the at least one open side of the housing for exposing the at least one item. A latch comprising a flexible member is connected to the tray. The flexible member is biased into engagement with the housing when the tray is in the first position. A lock assembly is engageable with the tray when the tray is in the first position. In use, the tray is secured in the first position by the latch and the lock and is angularly displaceable from the first position to the second position upon the simultaneous application of a first force to the latch, a second force to the lock and a torque to the tray.

In another aspect, the present application is directed to a child-resistant container for holding at least one item. The container includes a housing having upper and lower walls and a first tray pivotally mounted to the housing on a pivot axis for movement between a retracted position and an exposed position. In the retracted position, the first tray is positioned in the housing and in the exposed position, the first tray extends from the housing. A second tray is pivotally mounted to the housing for movement between a retracted position and an exposed position. In the retracted position, the second tray is positioned in the housing and in the exposed position, the second tray extends from the housing. The first and second trays are adapted for holding the at least one item. A common locking mechanism engages the first and second trays to releasably lock the first and second trays in the retracted position.

In another aspect, the present application is directed to a child-resistant container for holding at least one item. The container includes a housing having upper and lower walls and a first tray pivotally mounted to the housing on a pivot axis. The first tray is movable between a retracted position in which the first tray is positioned in the housing between the upper and lower walls and an exposed position in which the first tray extends from the housing. A second tray is pivotally mounted to the housing on the pivot axis and is movable between a retracted position in which the second tray is positioned in the housing between the upper and lower walls and an exposed position in which the second tray extends from the housing. The first and second trays are stacked in the housing when the first and second trays are in the retracted position.

In yet another aspect, the present application is directed to a tray for a child-resistant container that stores a plurality of blister packs. The tray includes a generally planar base and a side wall extending generally perpendicularly from a peripheral edge of the base plate. The base plate and the side wall define a storage space. A first stake extends generally perpendicularly from the base plate. The plurality of blister packs are removably mounted to the first stake and are positioned within the storage space in a combined position.

In a further aspect, the present application is directed to a child-resistant container for holding a plurality of blister packs. The container includes a housing having upper and lower walls and a tray pivotally mounted to the housing on a pivot axis for movement between a retracted position and an exposed position. In the retracted position, the tray is positioned in the housing and in the exposed position, the tray extends from the housing. The tray includes a base plate and a first stake extending generally perpendicularly from the base plate. The plurality of blister packs are releaseably mounted to the first stake.

In yet another aspect, the present application is directed to a container for holding at least one blister pack therein. The container includes a housing having upper and lower walls and a tray pivotally mounted to the housing for movement between a retracted position and an exposed position. In the retracted position, the tray is positioned in the housing and in the exposed position, the tray extends from the housing. The tray is pivotal on a plane that is generally parallel to the upper and lower walls. The tray includes a hole therein and the blister pack includes a plurality of medication doses. The blister pack is rotatably mounted to the tray such that one of the plurality of medication doses selectively aligns with the hole depending upon a rotational orientation of the blister pack.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
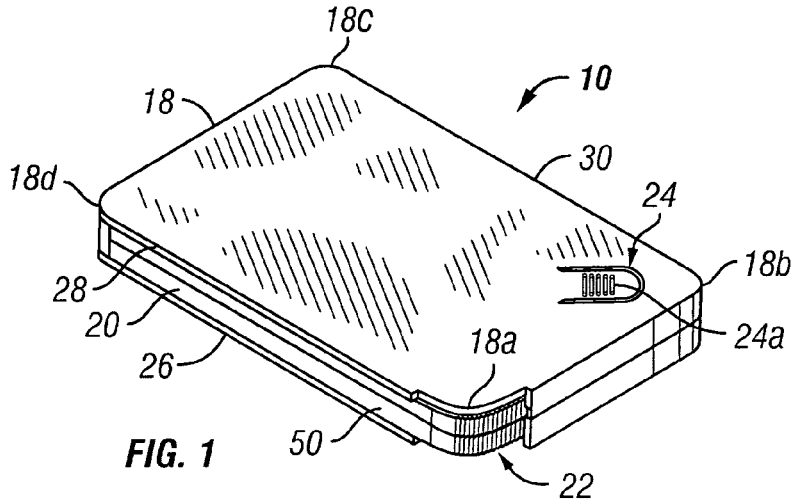
FIG. 1 is a top perspective view of a child-resistant container in accordance with a first preferred embodiment of the present invention

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the child-resistant container and designated parts thereof. The terminology includes the words above specifically mentioned, derivatives thereof, and words of similar import.

Referring to the drawings in detail, wherein like numerals indicate like elements throughout, there is shown in FIGS. 1-7 a first preferred embodiment of a child-resistant container 10 in accordance with the present invention. Referring to FIGS. 1-7 and 11, the container 10 of the first preferred embodiment is for containing a blister pack 202 (see also FIG. 10—blister packs 120, 122) having an arrangement of blisters, each containing a medication dose or tablet 202*a*. One having ordinary skill in the art will realize that the blister pack 202 typically includes a generally transparent top layer and a generally opaque rear layer that is bonded to the top layer such that moisture or other foreign matter is unable to penetrate the blister pack 202. The rear layer of the blister pack 202 is rupturable such that the medication dose 202*a* may be urged through the rear layer by applying a force, generally perpendicular to the top layer, to the medication dose 202*a*. The top layer is typically constructed of a polymeric material and the rear layer is typically constructed of a foil-type material or a laminate with at least one layer of foil therein.

Those having ordinary skill in the art will appreciate from this disclosure that contents or items other than tablets or capsules can be contained in the container 10 of the present application. For example, liquid or granular pharmaceuticals, contact lenses suspended in liquid or similar items potentially hazardous to children or adults can be safely contained in a readily accessible and convenient manner using the container 10 of the present invention. Accordingly, while the first preferred embodiment of the container 10 is discussed below as having a tray 20 for holding a blister pack, those having ordinary skill in the art will appreciate from this disclosure that the present invention is not limited to containers for containing blister packs.

The container 10 may be used to contain other contents without departing from the spirit and scope of the present invention. The necessary changes to the container 10 to accommodate contents other than a blister pack would be obvious to one of ordinary skill in the art when considered in combination with this disclosure. Accordingly, for brevity, the below disclosure is directed to a container 10 for blister packs having an arrangement of tablets with the understanding that the invention is not limited to containing blister packs or tablets.

Referring to FIGS. 1-3 and 6, the container 10 includes a housing 18, a tray 20, a latch 22, and a lock assembly 24. The housing 18 has a generally rectangular shape. However, those of skill in the art will appreciate from this disclosure that the container 10 of the present invention is not limited to a container having a housing of any particular shape. For example, the housing 18 may be cylindrically shaped, triangularly shaped, cubically shaped or the like without departing from the scope of the present invention. Preferably, the rectangular-shaped housing 18 has first, second, third, and fourth corners 18*a*, 18*b*, 18*c*, 18*d*, each of which has a generally arcuate shape. The first corner 18*a* preferably has a radius of curvature greater than the second, third and fourth corners 18*b*, 18*c*, 18*d* and is adjacent to the second and fourth corners 18*b*, 18*d*. As will be discussed further below, those having ordinary skill in the art will understand that the first corner 18*a* having the greater radius of curvature enables a user to readily ascertain the orientation of the container 10. The artisan will also understand that there are numerous other methods that may be employed to enable the user to determine the orientation of the container 10, such as a faceted corner or the use of a textured surface. Thus the invention is not limited to the use of generally arcuate corners, one of which having a distinguishable difference in its radius of curvature over others, as the sole method for determining orientation.

Figure 2:
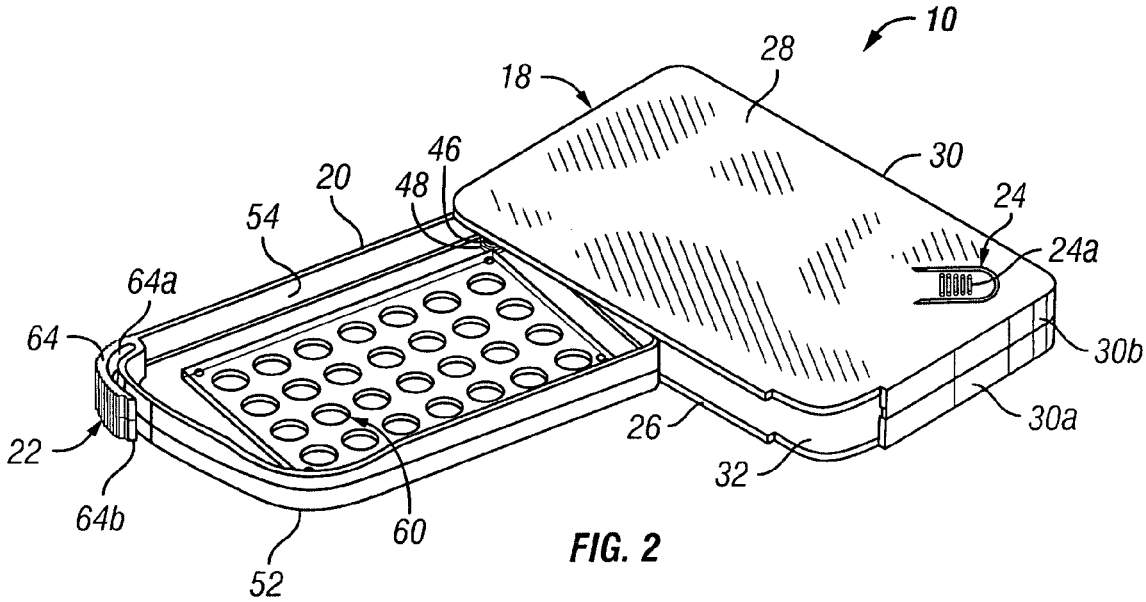
FIG. 2 is a top perspective view of the child-resistant container in FIG. 1 showing the tray in the second (open) position.
Figure 3:
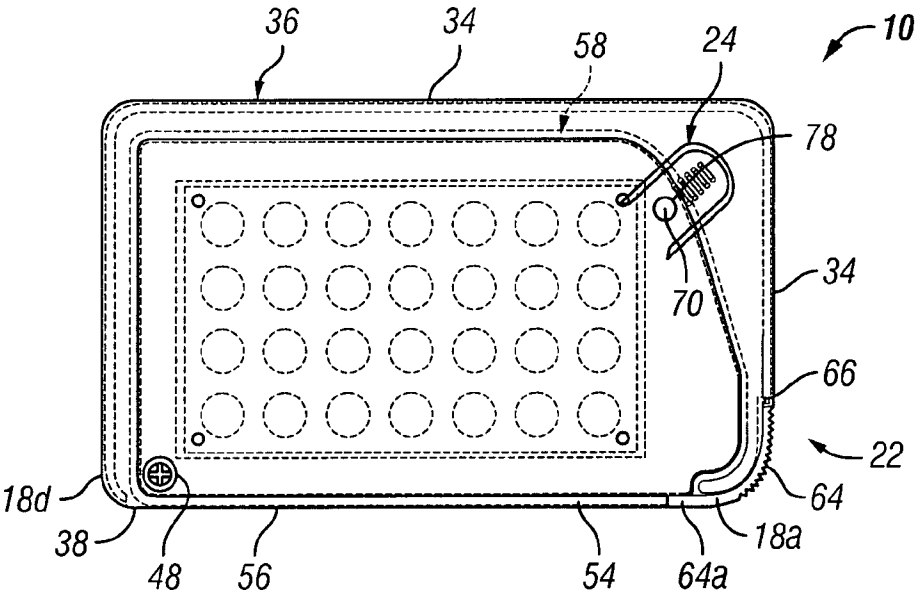
FIG. 3 is a top plan view of the child-resistant container in FIG. 1.
Figure 5:
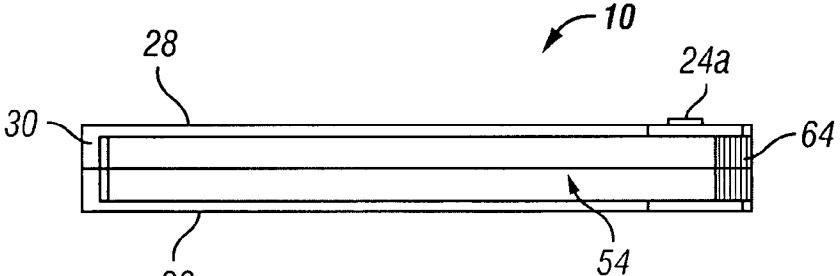
FIG. 5 is a front elevation view of the child-resistant container in FIG. 3.
Figure 6:
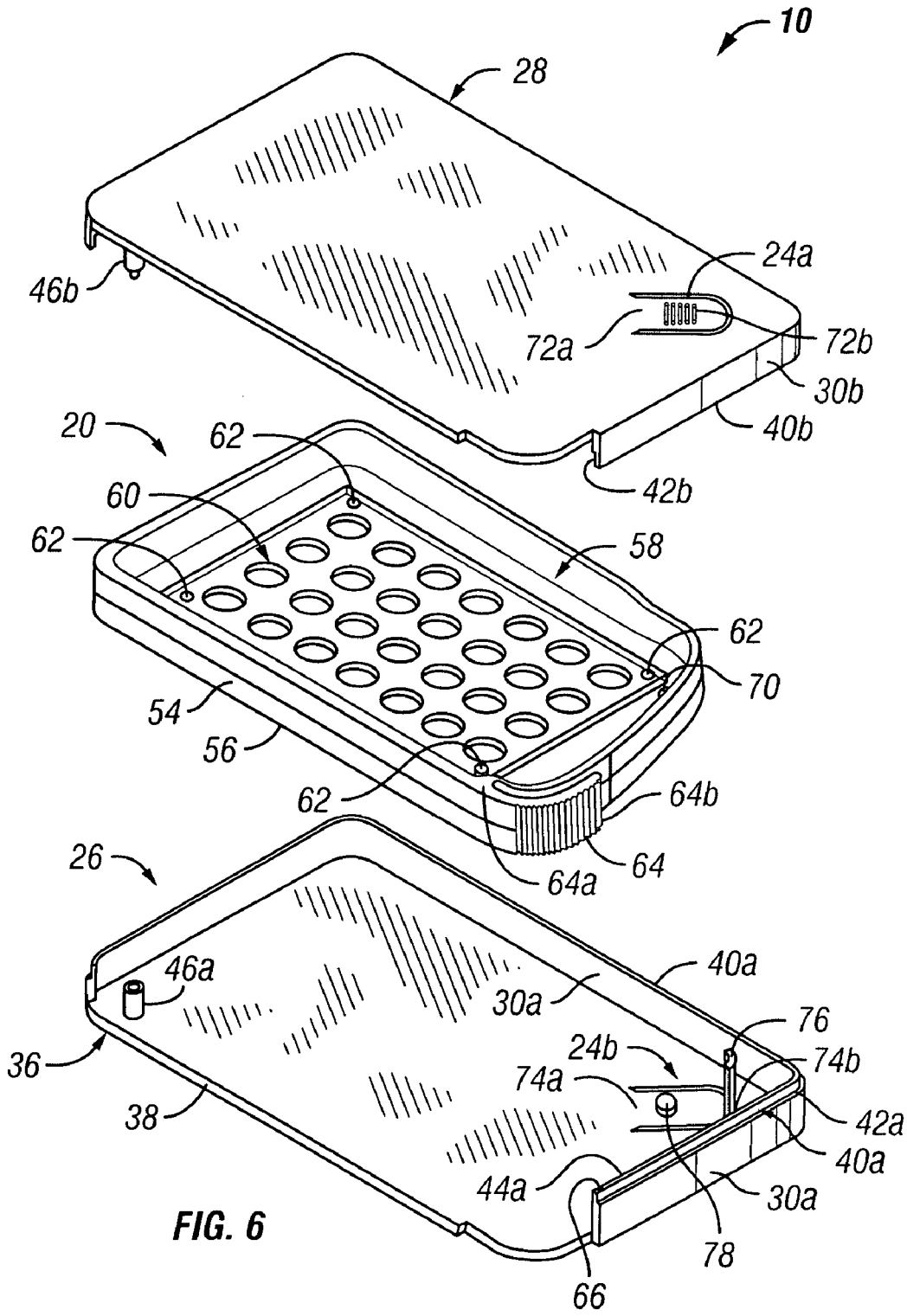
FIG. 6 is an exploded, top perspective view of the child-resistant container in FIG. 1.

Referring to FIGS. 2-3 and 6, the housing 18 has a base 26, a top 28, at least one closed side 30 and at least one open side 32. The at least one closed side 30 extends between the base 26 and the top 28 along a first portion 34 of a perimeter 36 of the base 26. The at least one open side 32 extends between the base 26 and the top 28 along a second portion 38 of the perimeter 36 of the base 26 and at least from the fourth corner 18*d* to the first corner 18*a*. Preferably the at least one closed side 30 comprises a base component 30*a* and a top component 30*b*. The base component 30*a* extends upwardly from the base 26 and the top component 30*b* extends downwardly from the top 28. The top edge 40*a* of the base component 30*a* of the at least one closed side 30 has a rabbet 42*a* with an outwardly projecting lip 44*a*. The bottom edge 40*b* of the top component 30*b* of the at least one closed side 30 has a rabbet 42*b* with an inwardly projecting lip (not shown) for mating in a snap fit connection with the corresponding rabbet 42*a* and lip 44*a* of the top edge 40*a* of the at least one closed side 30.

Those having ordinary skill in the art will understand from the present disclosure that the base component 30*a* and the top component 30*b* of the at least one closed side 30 are preferably formed as an integral part of the base 26 and top 28, respectively. The artisan also will understand that the base component 30*a* and the top component 30*b* may be secured to each other by a variety of other well known fastening methods such as an interference fit, screws, adhesives or the like. Further, the artisan will understand that the base component 30*a* and the top component 30*b* need not be formed as an integral part of the base 26 and top 28, respectively, but rather may be separate structures secured to the base 26 and top 28, respectively, by the methods discussed above without departing from the spirit and scope of the invention.

A pivot 46 extends between the base 26 and the top 28 through the tray 20 as discussed below. The pivot 46 is preferably positioned proximal to the fourth corner 18*d* of the housing 18 and comprises a first cylindrical structure 46*a* and a second cylindrical structure 46*b*. The first cylindrical structure 46*a* is integral with the base and extends upwardly from the base 26. The second cylindrical structure 46*b* is integral with the top 28, extends downwardly from the top 28 and engages the first cylindrical structure 46*a* in peg-in-hole like union. Those skilled in the art will understand from this disclosure that the pivot 46 may be any of a variety of well known connectors that provide for angular displacement between to the connected structures, such as a hinge, without departing from the spirit and scope of the invention.

The tray 20 preferably has a shape that generally corresponds to the shape of the base 26 and is preferably generally rectangular in shape. The tray 20 is pivotably connected to the housing 18. Preferably the tray 20 has a pivot hole 48 therethrough that is journaled with the pivot 46. The tray 20 is pivotable between a first (or closed) position 50 (FIG. 1) in which the tray 20 is in the housing 18 and a second (or open) position 52 (FIG. 2) in which the tray 20 extends through the at least one open side 32 of the housing 18. The tray 20 has at least one side 54 that extends upwardly along a first portion 56 of the perimeter 58 of the tray 20 and that corresponds to the at least one open side 32 of the housing 18. Those having ordinary skill in the art will understand from this disclosure that the at least one side 54 preferably, but not necessarily, extends around the entire perimeter 58 of the tray 20. The tray 20 additionally has a plurality of access holes 60 for providing access to the corresponding arrangement of blisters of the blister pack securable to the tray 20 by a plurality of pins 62 integral with the tray 20 and extending upwardly therefrom.

Figure 3A:
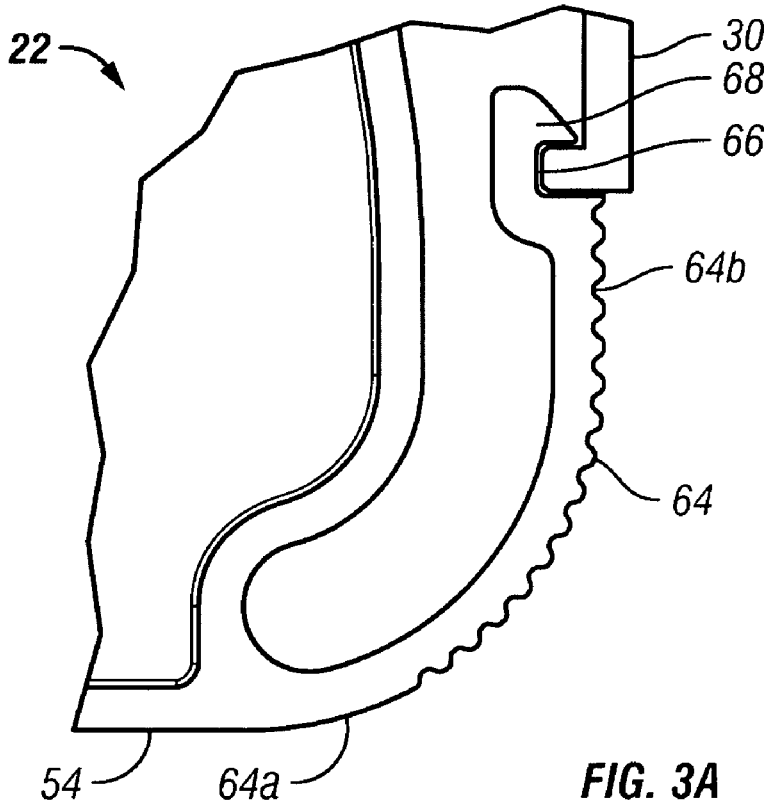
FIG. 3A is a greatly enlarged view of a portion of FIG. 3 showing the latch assembly.

Referring to FIGS. 3, 3A and 6, the latch 22 comprises a flexible member 64 associated with the tray 20 and a notch 66 associated with the housing 18. The flexible member 64 has a first end 64*a* that is integral with the at least one side 54 of the tray 20 and a second end 64*b* that has an outwardly projecting tang 68. The flexible member 64 is elastically biased outwardly. The notch 66 is in an inwardly facing surface of the at least one closed side 30 of the housing 18. The notch 66 is proximal to the first corner 18*a* of the housing and is positioned for releasably engaging the tang 68 when the tray 20 is in the first position 50 (FIG. 1). The outwardly facing surface of the latch 22 preferably, but not necessarily, is a textured surface. Those skilled in the art will understand from the present disclosure that the latch 22 may be one of a variety of well known latching devices, such as a slider or a snap without departing from the spirit and scope of the invention.

Referring to FIGS. 3 and 6, the lock assembly 24 is connected to the housing 18 and is engageable with a security aperture 70 in the tray 20 when the tray 20 is in the first position 50 (FIG. 1). The lock assembly 24 preferably comprises a flexible upper tab 24*a* and a flexible lower tab 24*b*. The upper tab 24*a* is preferably formed from a partial cutout in the top 28 and has a first end 72*a* integral with the top 28 of the housing 18 and a second free end 72*b*. The upper tab 24*a* is elastically biased outwardly and displaceable inwardly. The lower tab 24*b* is preferably formed from a partial cutout in the base 26 of the housing 18 and has a first end 74*a* integral with the base 26 and a second free end 74*b*. The lower tab 24*b* is elastically biased inwardly and displaceable outwardly. An upwardly extending push rod 76 is integral with the lower tab 24*b* proximal to the second free end 74*b* and engages the upper tab 24*a*. An upwardly extending security boss 78 spaced from the push rod 76 is also integral with the lower tab 24*b* and is positioned for removable insertion into the security aperture 70 in the tray 20, when the tray 20 is in the first position 50. Those skilled in the art will understand from the present disclosure that other methods may be used to lock the tray 20 in the first position 50 such an outwardly biased bolt slideable within a bore in the top 28 of the housing 18 without departing from the spirit and scope of the present invention.

Figure 2A:
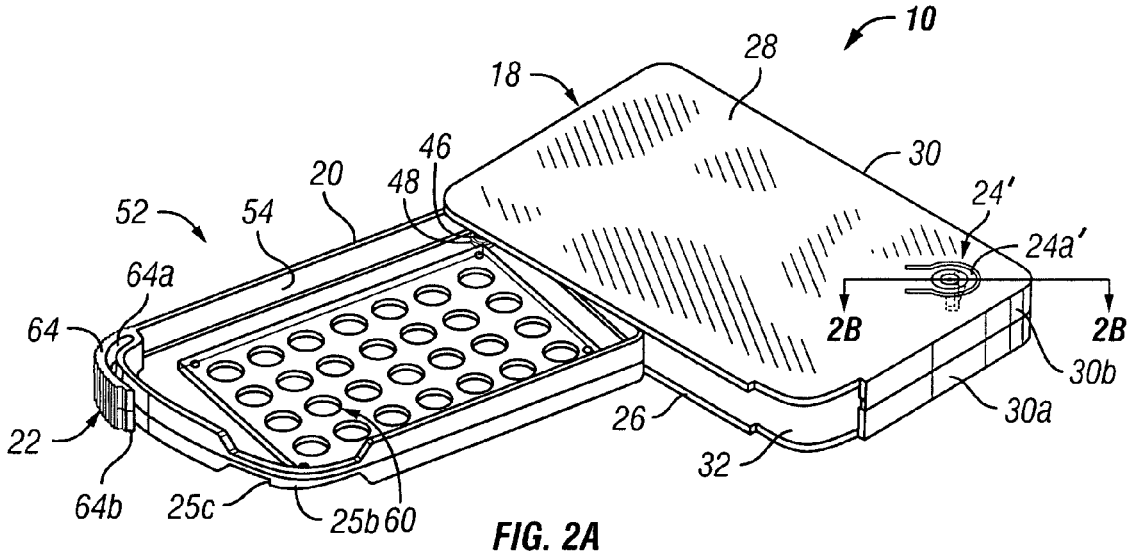
FIG. 2A is a top perspective view of the child-resistant container in FIG. 1 showing the tray in the second (open) position and a second embodiment of a second locking mechanism.

Referring to FIG. 2A, a second embodiment of the lock assembly or second locking mechanism 24' is movably mounted to the top wall 28 of the housing 18 and includes an arm 25 that extends downwardly from an upper tab 24*a'* with a hook-shaped member 25*a* at a distal end. The second locking mechanism 24' is movable between a locking position and a release position. The second locking mechanism 24' engages and locks the tray 20 within the housing 18 when the tray 20 is in the retracted position and the second locking mechanism 24' is in the locking position. In this embodiment the second locking mechanism 24' does not include the lower tab 24*b* that is mounted to the base component 30*a* of the housing 18. The second embodiment of the second locking mechanism 24' further includes a cam surface 25*b* and a shoulder 25*c* on the tray 20. In the preferred alternative embodiment, the cam surface 25*b* and shoulder 25*c* are integrally molded into the side 54 of the tray 20 adjacent a corner of the tray 20.

In operation, the cam surface 25*b* moves the second locking mechanism 24' from the locking position to the release position as the tray 20 pivots from the exposed position toward the retracted position. The second locking mechanism 24' engages the shoulder 25*c* when the tray 20 is in the retracted position, thereby locking the tray 20 in the retracted position. To release the tray 20 from the retracted position, the upper tab 24*a*' is depressed toward the tray 20, thereby moving the hook-shaped member 25*a* out of engagement with the shoulder 25*c*, the latch 22 is actuated and the tray 20 is released to pivot toward the open position upon the application of a torque to the tray 20. When returning the tray 20 to the retracted position from the open position, the cam surface 25*b* contacts the hook-shaped member 25*a*, moving the upper tab 24*a*' from the locking position to the release position. When the hook-shaped member 25*a* clears the cam surface 25*b*, the resilient upper tab 24*a*' urges the hook-shaped member 25*a* to the locking position, thereby engaging the hook-shaped member 25*a* with the shoulder 25*c* and locking the tray 20 in the retracted position.

Figure 8:
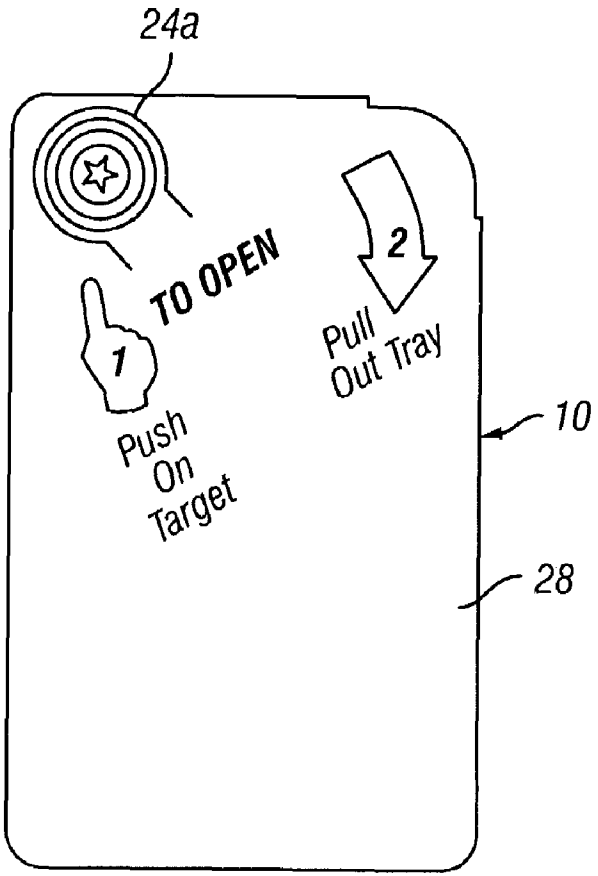
FIG. 8 is a top plan view of the child-resistant container in FIG. 1, showing another preferred ornamental design for the top of the housing.
Figure 7:
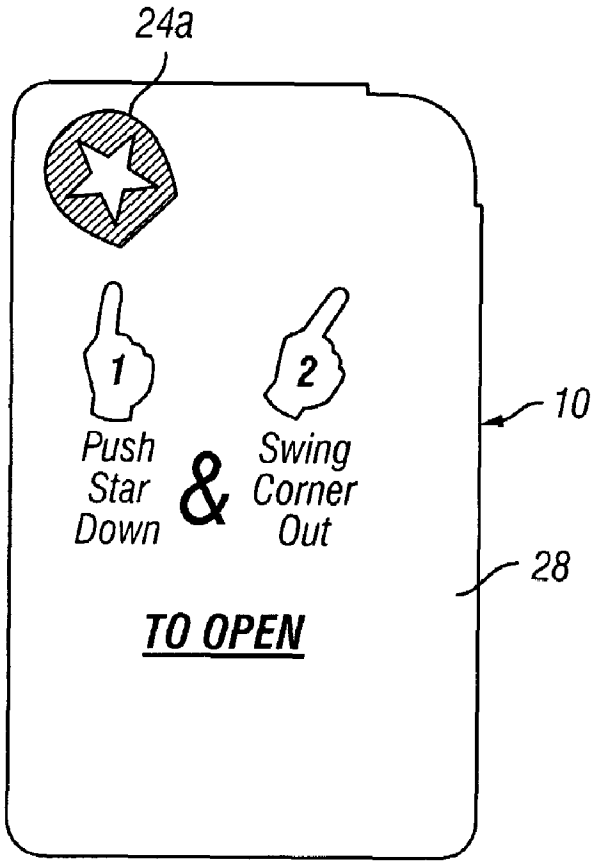
FIG. 7 is a top plan view of the child-resistant container in FIG. 1, showing a preferred ornamental design for the top of the housing.

Referring to FIGS. 7 and 8, the upper tab 24*a* and the upper tab 24*a*' of the second preferred embodiment of the locking mechanism 24' preferably includes an ornamental design such as a star or a target applied to its outer surface as depicted in the referenced figures to direct the user's attention to the location of the upper tab 24*a*, 24*a*' on the container 10. Additionally, preferably, but not necessarily, the top 28 of the container 10 may bear markings such as the markings shown in FIGS. 7, 8 and 11 providing guidance to the user regarding how to operate the device. The ornamental design on the upper tab 24*a*, 24*a*' is not limited to a star or target and may take on nearly any ornamental shape or pattern that provides in indication to a user for actuating the locking mechanism 24, 24'.

Those having ordinary skill in the art will understand from the above disclosure that the tray 20 is secured in the first position 50 by the latch 22 and one of the lock assemblies 24, 24' and is angularly displaceable from the first position 50 toward the second position 52 upon the simultaneous application of an inwardly directed force to the flexible member 64 of the latch 22 and one of the upper tabs 24*a*, 24*a*' of the locking mechanism 24, 24' and a torque to the tray 20.

Preferably, but not necessarily, the above-disclosed components of the container 10 are fabricated from die-formable polymeric materials. However, a wide variety of well-known materials including but not limited to metals such as aluminum or stainless steel may be used without departing from the scope and spirit of the invention.

The container 10 is preferably ergonomically designed for simplicity of use as follows. The container 10 with the tray 20 in the first or closed position 50 grasps the container 10 in the left hand with the at least one closed side 30 facing the palm of the user's hand, the top 28 facing upwardly and the left thumb placed over the upper tab 24*a* of the lock assembly 24. The index finger of the user's right hand is placed on the flexible member 64 of the latch 22. To open the container 10, the user simultaneously applies with the left thumb and right index finger an inwardly directed force to the upper tab 24*a* and the flexible member 64 respectively and a torque to the tray 20. The force applied to the upper tab 24*a* causes the upper tab 24*a* to be displaced inwardly and thereby transfer the force to the push rod 76 of the lower tab 24*b* which, in turn, is displaced downwardly and outwardly to withdraw the security boss 78 from the security aperture 70 and unlock the tray 20.

The application of the inwardly directed force to the flexible member 64 causes an inward displacement of the flexible member 64, which in turn causes the withdrawal of the tang 68 from the notch 66 in the at least one closed side 30 of the housing 18. The simultaneous withdrawal of the security boss 78 and the tang 68 frees the tray 20 for angular displacement about the pivot 46. With both the upper tab 24*a* and the flexible member 64 inwardly displaced, the application of the torque to the tray 20 pivots the tray 20 form the first (closed) position 50 to the second (open) position 52.

When the tray 20 is in the open position 50, the user may place a new blister pack in the tray 20 and secure it in position with the blister pack retention pins 62, remove a tablet from a blister of an already contained blister pack, or replace an already present blister pack with another.

The application of a reverse torque to the tray 20 returns the tray 20 to the closed position 50. When the tray 20 is returned to the closed position 50, in the absence of the force applied to the upper tab 24*a* and the flexible member 64, the tang 68 is inserted in the notch 66 and the security boss 78 is inserted in the security aperture 70 due to the biased positioning of the latch 22 and the lock assembly 24.

Figure 9:
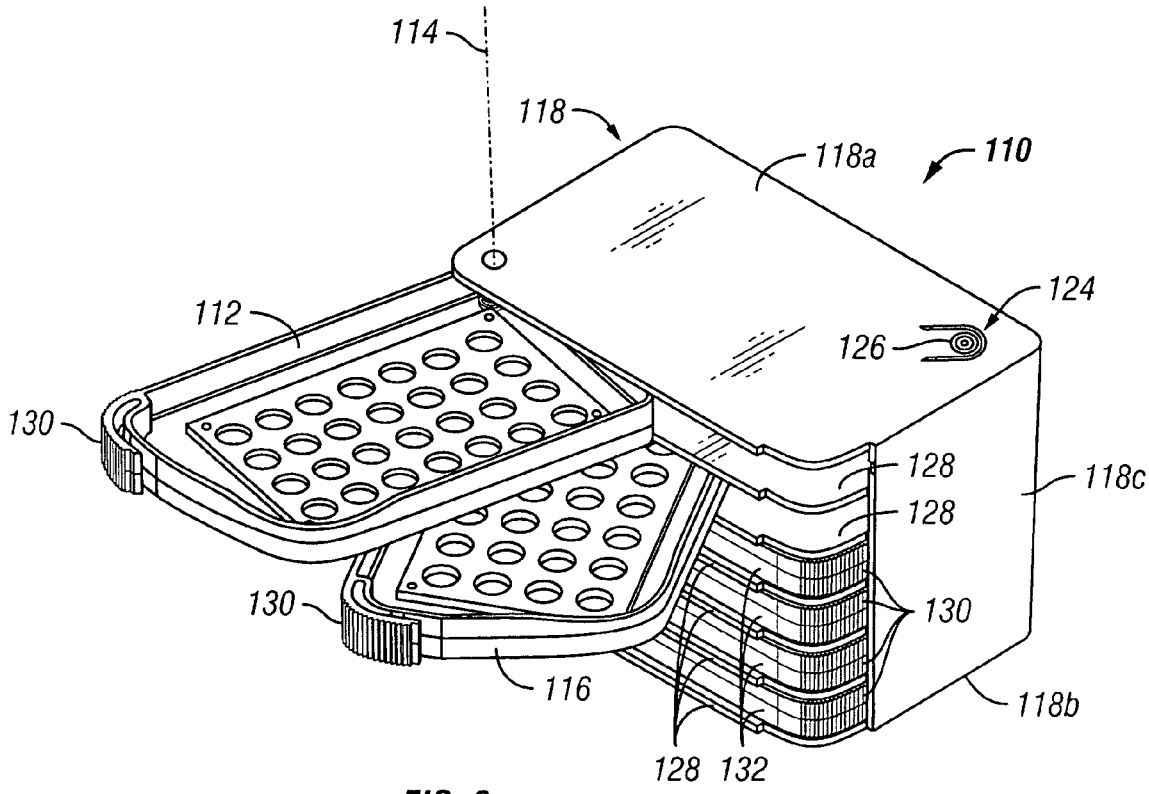
FIG. 9 is a top perspective view of a child-resistant container in accordance with a second preferred embodiment of the present application.

Referring to FIG. 9, a second preferred embodiment of a child-resistant container 110 for holding at least one item includes a housing 118 having an upper wall 118*a* and a lower wall 118*b*. In the preferred embodiment, the housing 118 also includes side walls 118*c* that cover at least portions of three sides of the housing 118. The housing 118 is preferably constructed of a generally rigid, injection molded polymeric material and has a generally boxy-shape. The preferred housing 118 has a similar construction to the housing 18 of the first preferred embodiment. However, one having ordinary skill in the art will realize that the housing 118 may be constructed of nearly any material and have nearly any shape that is able to withstand the normal operating conditions and meet the requirements of the child-resistant container 110 of the second preferred embodiment.

A first tray 112 is mounted on a pivot axis 114 for movement between a retracted position in which the first tray 112 is positioned in the housing 118 and an exposed position (FIG. 9) in which the first tray 112 extends from the housing 118. In the second preferred embodiment, the first tray 112 is preferably constructed of the same or a similar material as the housing 118 and has a similar construction or essentially the same construction as the tray 20 of the first preferred embodiment. However, one having ordinary skill in the art will realize that the first tray 112 may have nearly any shape, construction or be produced using nearly any process that permits the first tray 112 to be mounted to the housing 118 and to be moveable between the retracted and exposed positions.

The child-resistant container 110 of the second preferred embodiment also includes a second tray 116 that is pivotally mounted to the housing 118. The second tray 116 is mounted to the housing 118 for movement between a retracted position in which the second tray 116 is positioned in the housing 118 and an exposed position in which the second tray 116 extends from the housing 118 (FIG. 9). In the second preferred embodiment, the second tray 116 has the same or a similar construction when compared to the first tray 112, however, one having ordinary skill in the art will realize that the second tray 116 may have nearly any construction or shape that is able to be mounted to the housing 118 and is moveable between the retracted and exposed positions.

In the second preferred embodiment, the second tray 116 is pivotally mounted to the housing 118 on the pivot axis 114 immediately adjacent the first tray 112. The first and second trays 112, 116 may be mounted on a pivot shaft (not shown) that extends between the upper wall 118*a* and lower wall 188*b*, preferably adjacent one corner of the housing 118. This construction and positioning of the pivot axis 114 and pivot shaft accommodates movement of the first and second trays 112, 116 between the retracted and extended positions, respectively. One having ordinary skill in the art will realize that the first and second trays 112, 116 are not necessarily both pivotally mounted to the housing 118 on the pivot axis 114 and may be mounted in a different fashion to the housing 118 or at an alternative position. For example, the first tray 112 may be pivotally mounted along the pivot axis 114 and the second tray 116 may be slideably mounted to the housing 118 or pivotally mounted to the housing 118 on a different axis that is preferably positioned at one of the other corners of the housing 118.

Figure 10:
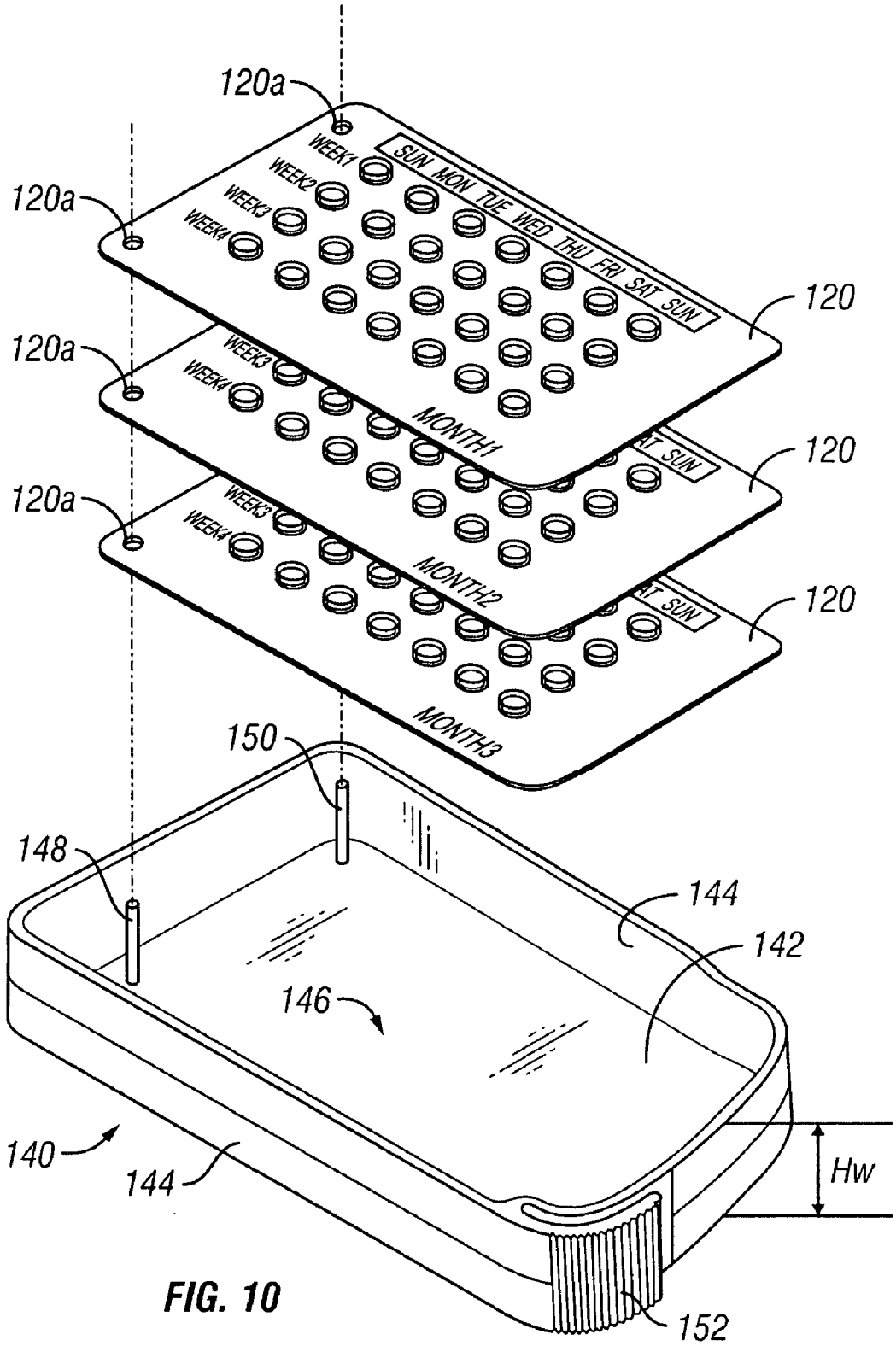
FIG. 10 is a top perspective view of a tray for a child-resistant container including blister packs exploded therefrom in accordance with a third preferred embodiment of the present application.

The first and second trays 112, 116 are adapted for holding the at least one item, which in the preferred embodiment is comprised of first and second blister packs 120 (FIG. 10). The first blister pack 120 is preferably mounted on the first tray 112 and the second blister pack 120 is preferably mounted on the second tray 116. The first and second trays 112, 116 are preferably sized and have a shape that accommodates the blister packs 120 and allows simple mounting of the blister packs 120 to the trays 112, 116. The first and second blister packs 120 are preferably mounted to the first and second trays 112, 116 such that the blister packs 120 are inaccessible when the first and second trays 112, 116 are in the retracted positions and are exposed when the first and second trays 112, 116 are in the exposed positions, respectively. In the preferred embodiment, the blister packs 120 include seven columns and four rows of medication. This configuration represents the medication for a patient during a four week period or for approximately one-month. The first and second trays 112, 116 are preferably configured to accept this type of blister pack 120, 122 such that the individual doses of medication are exposed from the trays 112, 116. One having ordinary skill in the art will realize that the first and second blister packs 120, 122 and first and second trays 112, 116 are not limited to the above-described one-month dose configuration and may be configured to accommodate nearly any shape and sized blister pack or other item that is convenient for storage in the child-resistant container 110. In addition, one having ordinary skill in the art will realize the above-described configuration results in twenty-eight single items of medication on each tray, which would store doses of medication that is taken each day for a four week period or slightly short of one month in most cases. Additional slots for extra doses of medication for particular months may be inserted to accommodate single does for each day of a month.

A common locking mechanism 124 engages the first and second trays 112, 116 to releasably lock the first and second trays 112, 116 in the retracted positions, respectively. In the second preferred embodiment, the common locking mechanism 124 is mounted to the housing 118 and releasably locks the first tray 112 and the second tray 116 in the retracted positions. The preferred common locking mechanism 124 is constructed in a similar manner and has a similar operation to the lock assembly 24 of the first preferred embodiment. Specifically, the common locking mechanism 124 preferably includes a flexible tab 126 that is mounted to the upper wall 118*a* and has a target thereon. The common locking mechanism 124 also preferably includes a plurality of flexible lower tabs (not shown) that are similar in construction and operation to the flexible lower tab 24*b* of the first preferred embodiment. The flexible lower tabs of the second preferred embodiment are preferably mounted to intermediate walls 128 of the housing 118 that are vertically spaced between the upper and lower walls 118*a*, 118*b*.

Figure 2B:
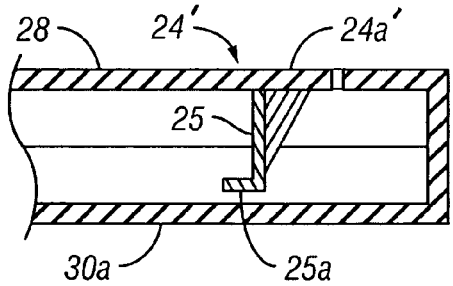
FIG. 2B is a cross-sectional view of the second locking mechanism of FIG. 2A, taken along line 2B-2B of FIG. 2A.
Figure 4:
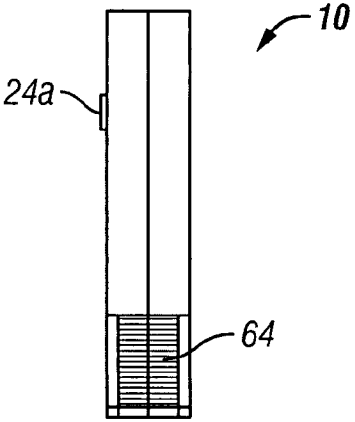
FIG. 4 is a right-side elevation view of the child-resistant container in FIG. 3.

One having ordinary skill in the art will realize how the flexible lower tabs are accommodated by the intermediate walls 128 with one flexible lower tab accommodated by the lower wall 118*b*. The flexible lower tabs will not be described in further detail, as being understood by one having ordinary skill in the art in structure and operation. In addition, one having ordinary skill in the art will realize that the child-resistant container 118 of the second preferred embodiment does not require flexible lower tabs constructed in the same manner as the flexible lower tabs 24*b* of the first preferred embodiment and may include a single flexible lower tab with a single push rod extending between the flexible tab 126 at the upper wall 118*b* and being mounted to the lower wall 118*b*. The single push rod would include cantilevered locking arms (not shown) extending therefrom to releaseably engage at least the first and second trays 112, 116 in the retracted positions. This configuration would be similar to the second preferred embodiment of the locking mechanism 24' shown in FIGS. 2A and 2B.

In the second preferred embodiment, the first and second trays 112, 116 each include an individual locking mechanism 130. The individual locking mechanisms 130 are releaseably engageable with the housing 118 to releaseably lock the first and second trays 112, 116 in the retracted positions in association with the common locking mechanism 124. In second the preferred embodiment, the individual locking mechanisms 130 are constructed and operate in the same manner as the latch 22 of the first preferred embodiment (FIG. 3A). However, one having ordinary skill in the art will realize that the individual locking mechanisms 130 are not limited to the identical structure and/or construction of the latch 22 of the first preferred embodiment and may be constructed and have a structure of nearly any locking mechanism that releaseably secures the first and second trays 112, 116 in the retracted positions.

In the second preferred embodiment, the first and second trays 112, 116 are only removable from the retracted positions to the exposed positions upon simultaneously releasing the common locking mechanism 124 and the respective individual locking mechanism 130. For example, to release the first tray 112 from the retracted position to the exposed position, the flexible tab 126 is depressed toward the lower wall 118*b*, thereby releasing the common locking mechanism 124 and the individual locking mechanism 130 is depressed toward a center of the first tray 112, which releases the individual locking mechanism 130 from the housing 118. A torque may then be applied to the first tray 112 about the pivot axis 114 to move the first tray 112 from the retracted position to the exposed position. An item that is mounted to the first tray 112 may be removed from the tray 112, for example, a unit of medication may be removed from a blister pack 120 that is mounted to the first tray 112. The torque may be applied manually by a patient at the individual locking mechanism 130 or anywhere that is accessible on the first tray 112 or may be applied by a spring (not shown) that is mounted at one end to the first tray 112 and to the housing 118 at another end.

One or more supplemental trays 132 may be pivotally mounted to the housing 118 on the pivot axis 114 in the second preferred embodiment. The supplemental tray 132 or trays 132 are separate from the first and second trays 112, 116 and are also pivotable between retracted (FIG. 9) and exposed positions. Nearly any number of supplemental trays 132 may be mounted to the housing 118 in a stacked manner or in nearly any configuration that allows mounting of the supplemental trays 132 to the housing 118 and movement of the supplemental trays 132 to and between the retracted and exposed positions. The supplemental trays 132 preferably have the same shape, construction, configuration and operation as the first and second trays 112, 116.

The common locking mechanism 124 is mounted to the housing 118 and releasably maintains the supplemental trays 132 in the retracted position. The supplemental trays 132 also include an individual locking mechanism 130 that releaseably engages the housing 118 when the supplemental trays 132 are in the retracted position. The supplemental trays 132 preferably accommodate additional items for use by the patient. For example, the supplemental trays 132 may accommodate additional blister packs 120 that contain medication associated with different months or periods of time than the medication contained in the first and second trays 112, 116 or may be associated with different medication than the medication mounted to the first tray 112 or the second tray 116.

The individual locking mechanisms 130 releaseably engage the housing 118 when of the supplemental trays 132 are in the retracted position. The inclusion of the common locking mechanism 124 and individual locking mechanisms 130 prevent easy access to the item mounted to one of the trays 112, 116, 132 to a child or an individual having limited manual dexterity. Specifically, in order to pivot the trays 112, 116, 132 from the retracted to the exposed position, the common locking mechanism 124 must be released and the individual locking mechanisms 130 must be released concurrently.

The preferred first, second and supplemental trays 112, 116, 132 are movable from the retracted position by application of a release force to the common locking mechanism 124 and a depression force to the respective individual locking mechanism 130. Accordingly, both the common and individual locking mechanisms 124, 130 must be released to release one of the trays 112, 116, 132. For example, simply releasing the common locking-mechanism 124 results in the trays 112, 116, 132 being retained in the retracted positions by the individual locking mechanisms 130. Likewise, releasing one of the individual locking mechanisms 130 of any of the trays 112, 116, 132 results in the trays 112, 116, 132 being locked in the retracted positions by the common locking mechanism 124.

Any of the trays 112, 116 132 may be individually moved from the retracted to the exposed position without releasing any of the other trays 112, 116, 132 from the retracted to the exposed positions. For example, to release only the second tray 116 from the retracted to the exposed position, the common locking mechanism 124 is released, the individual locking mechanism 130 of the second tray 116 is released and the second tray 116 is pivoted from the retracted to the exposed position. The first and any other supplemental trays 132 are locked or retained in the retracted position by the respective individual locking mechanisms 130 in this situation.

The preferred supplemental trays 132 are mounted to the housing 118 on the pivot axis 114. One having ordinary skill in the art will realize that the supplemental trays 132 are not limited to being pivotally mounted to the housing 118 on the pivot axis 114 and may be slideably mounted to the housing 118 or pivotally mounted to the housing 118 at a location other than at the pivot axis 114. However, mounting of all the trays 112, 116, 132 on the pivot axis 114 is preferred for a simple and consistent structure that is relatively simple to operate.

In the second preferred embodiment, the first, second and supplemental trays 112, 116, 132 are stacked in the housing 118 between the upper and lower walls 118*a* and 118*b* when each of the trays 112, 116, 132 is in the retracted position. Such a configuration consolidates the trays 112, 116, 132 within the housing 118 and provides for relatively easy access to the item that is mounted to one of the trays 112, 116, 132 and a simplified construction and operation for the child-resistant container 110 of the second preferred embodiment. However, one having ordinary skill in the art will realize that alternative constructions of the child-resistant container 110 of the second preferred embodiment may be employed where the trays 112, 116, 132 are not stacked when they are in the retracted positions.

In the second preferred embodiment, the first, second and supplemental trays 112, 116, 132 include blister packs 120 mounted thereto that store medication for a predetermined month or other time period. Accordingly, the individual trays 112, 116, 132 may each store a different medication for a single month or other time period or may store the same medication for consecutive months for use by a patient. For example, the child-resistant container 110 may be comprised of the first tray 112, the second tray 116 and ten supplemental trays 132 that store the same medication for the twelve months of one year. Accordingly, a patient's medication for one year may be stored in a single child-resistant container 110 on twelve trays 112, 116, 132. Alternatively, the twelve trays 112, 116, 132 may retain twelve different medications that will be taken over one month by a patient.

Referring to FIG. 10, a tray 140 for a child-resistant container of a third preferred embodiment (not shown) that stores a plurality of blister packs 120 includes a generally planar base 142 and a side wall 144 extending generally perpendicularly from a perpendicular edge of the base plate 142. The base plate 142 and side wall 144 of the tray 140 define a storage space 146. The child-resistant container of the third preferred embodiment preferably has a similar construction as the child-resistant container 10 of the first preferred embodiment besides having a generally greater distance between the top and base walls 28, 26, as will be described in greater detail below.

In the preferred embodiment, the tray 140 is constructed of a generally rigid polymeric material and has a generally shoe box-type configuration. One having ordinary skill in the art will realize that the tray 140 may be constructed of nearly any material and have nearly any shape or configuration that is able to withstand the normal operating conditions and requirements of the tray 140.

The tray 140 also includes a first stake 148 that extends generally perpendicularly from the base plate 142. The plurality of blister packs 120 are removably mounted to the first stake 148 and are positioned within the storage space 146 in a confined position. In a preferred embodiment, the storage space 146 is large enough to accommodate three blister packs 120 therein, which are each mounted to the first stake 148 to retain the blister packs 120 within the storage space 146 in the confined position.

The preferred tray 140 has a wall height $H_w$ that is defined by the side wall 144, is at least one-half inch (½") and is preferably three-quarters of an inch (¾"). One having ordinary skill in the art will realize that the wall height $H_w$ is not limited to being between one-half and three quarters of an inch and may have nearly any dimension that creates a storage space 146 on the tray 140. For example, if low profile blister packs 120 are mounted on the first stake 148 of the tray 140, the wall height $H_w$ may be less than ½" to accommodate the low profile blister packs 120. Alternatively, the wall height $H_w$ may be greater than three-quarters of an inch (¾") to accommodate thick or high profile blister packs 120 or any number of stacked blister packs 120. The typical stack of three blister packs 120 is accommodated by a three-quarter inch (¾") wall height $H_w$.

A second stake 150 extends generally perpendicularly from the base plate 142 in a preferred embodiment and is spaced from the first stake 148. The blister packs 120 are preferably removably mounted to the first and second stakes 148, 150 in the confined position. The second stake 150 is not required for the operation of the tray 140 and is typically provided on the tray 140 to provide additional stability for the mounting of the blister packs 120 to the tray 140.

In the preferred embodiment, the blister packs 120 include a pair of holes 120*a* at one of their ends that are adhesively bonded to the first and second stakes 148, 150. One having ordinary skill in the art will realize that the blister packs 120 are not limited to the inclusion of the holes 120*a* or to being adhesively bonded at the holes 120*a* to the first and second stakes 148, 150. For example, the blister packs 120 may be clamped, bolted or secured by hook and loop material to only the first stake 148 to mount the blister packs 120 to the tray 140 or to the base plate 142 or side wall 144.

Referring to FIGS. 1, 2 and 10, the tray 140 may be adapted for use with the child-resistant containers 10, 110 of the first or second preferred embodiments. For example, the tray 140 may be pivotally mounted to the housing 18 on the first and second cylindrical structures 46*a*, 46*b*. The tray 140 would be pivotable between a retracted position wherein the tray 140 is positioned within the housing 18 between the upper and lower walls 28, 32 and an exposed position wherein the tray 140 and blister packs 120 are accessible in the tray 140. This preferred tray 140 would also include a manual locking mechanism 152 that has a structure, configuration and operation that is preferably the same as the latch 22 of the first preferred embodiment but not so limited. The preferred manual locking mechanism 152 is mounted to the side wall 144 and engages the housing 18 to releasably lock the tray 140 in the retracted position. One having ordinary skill in the art will readily recognize how the tray 140 is adaptable to inclusion in the child-resistant container 10 of the first preferred embodiment as a replacement for the tray 20 of the first preferred embodiment.

Mounting the plurality of blister packs 120 in the storage space 146 permits a user to store multiple blister packs 120 including identical medication for various months of the year or different medications for the same month, while storing the medication in the storage space 146 of the tray 140. The inclusion of a plurality of blister packs 120 in the tray 140 enhances the convenience and access to the item or medication in the blister packs 120.

In the preferred embodiment, the plurality of blister packs 120 are secured to the first and second stakes 148, 150 and the items of medication from the uppermost blister pack 120 are removed and used before any of the lower blister packs 120. When all of the items or medications are removed from the uppermost blister pack 120, the uppermost blister pack 120 may be ripped or released from the first and second stakes 148, 150, thereby completely exposing the next lowest blister pack 120 from the storage space 146. The lower blister packs 120 may then be exhausted of their medication or additional blister packs 120 may be mounted on top of the lower blister packs 120 to the first and second stakes 148, 150.

Referring to FIGS. 9 and 10, one having ordinary skill in the art will also realize that the tray 140 may be adapted for use in the child-resistant container 110 of the second preferred embodiment. Specifically, multiple trays 140 may be stacked in the housing 118 such the trays 140 are movable between the retracted position and the exposed position. In the retracted position, the trays 140 would be locked by the common locking mechanism 124 and the manual locking mechanism 152.

Figure 11:
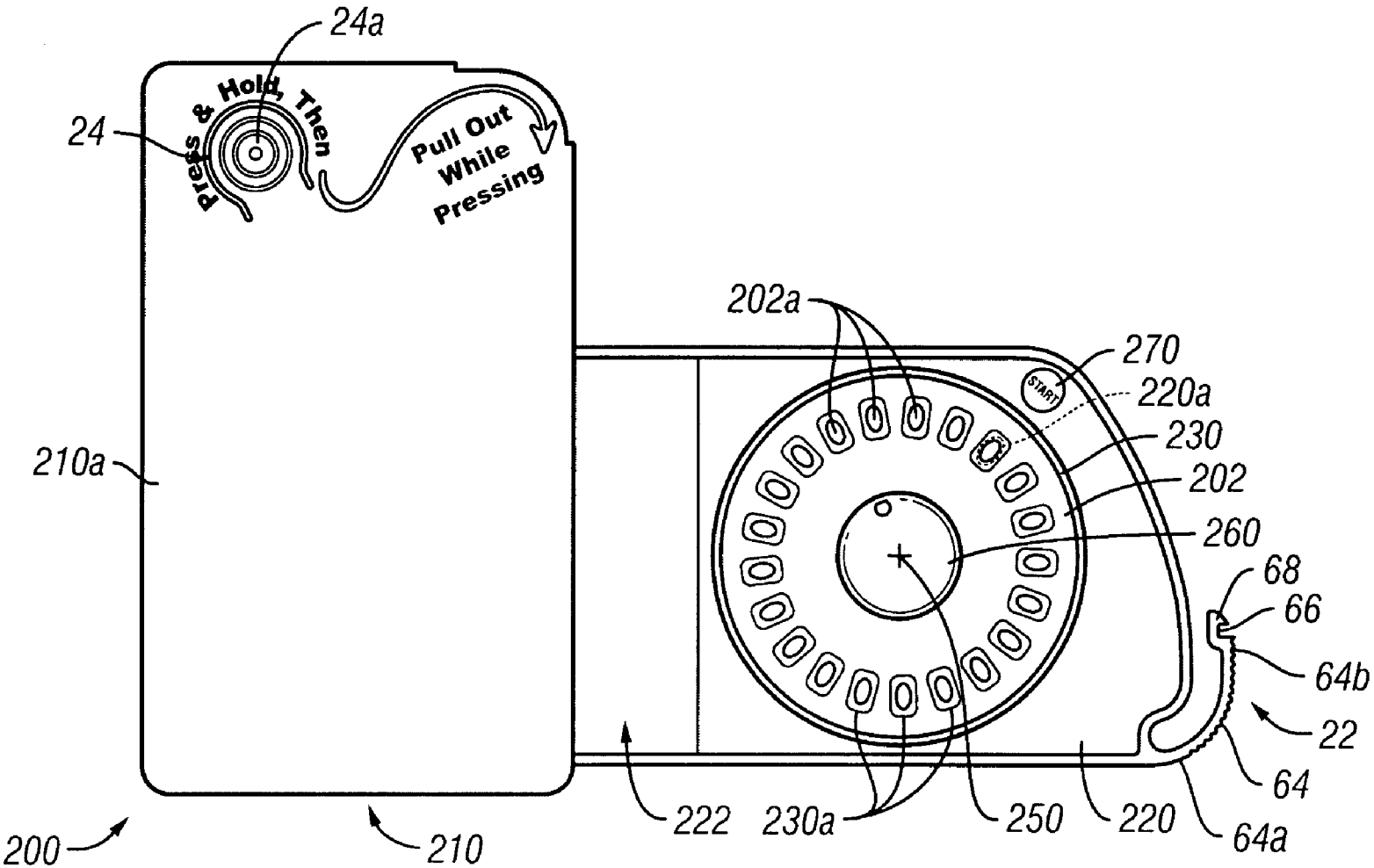
FIG. 11 is a top perspective view of a child-resistant container including a rotatable blister pack therein, in accordance with a fourth preferred embodiment of the present application.

Referring to FIG. 11, in a fourth preferred embodiment, a container 200 for holding at least one, generally disc-shaped blister pack 202 includes a housing 210 having an upper wall 210*a* and a lower wall (not shown). A tray 220 is mounted to the housing 210 for pivotal movement between a retracted position in which the tray 220 is positioned in the housing 210 and an exposed position (FIG. 11) in which the tray 220 extends from the housing 210. The tray 220 is pivotable on a plane that is generally parallel to the upper and lower walls 210*a*. In the preferred embodiment, the housing 210 and tray 220 have a similar configuration and operation when compared to the above-described trays 20, 112, 116, 132 and housings 18, as will be understood by one having ordinary skill in the art.

In the fourth preferred embodiment, the tray 220 includes a hole 220*a* therein. The hole 220*a* preferably extends through the tray 220 and has a generally circular or oval cross-section. The hole 220*a* is not limited to circular or oval cross-sections and may have nearly any cross-section that permits the hole 220*a* to perform its normal operating function, as will be described in greater detail below.

The blister pack 202 includes a plurality of medication doses or tablets 202*a* therein and is rotatably mounted to the tray 220 such that one of the plurality of medication doses 202*a* selectively aligns with the hole 220*a* depending upon a rotational orientation of the blister pack 202. One having ordinary skill in the art is familiar with the general structure and construction of the blister pack 202 and the mounting of individual medication doses 202*a* therein.

Therefore, the structure and construction of the blister pack 202 will not be described in further detail. In the fourth preferred embodiment, the individual medication doses 202*a* have a generally circular cross-section that is slightly smaller than the generally circular or oval cross-section of the hole 220*a*. Accordingly, the individual medication doses 202*a* are able to move through the hole 220*a* without becoming wedged within the hole 220*a*. The medication doses 202*a* are not limited to generally circular or oval cross-sections and may take on nearly any shape or size and the hole 220*a* may also take on nearly any shape or size that permits the individual medication doses 202*a* to move through the hole 220*a* without becoming wedged or jammed therein.

In the fourth preferred embodiment, the container 200 also includes a blister disc 230 that is removably and rotatably mountable to the tray 220. The blister pack 202 is fixed to the blister disc 230 and the blister disc 230 includes a plurality of slots 230*a* that correspond to the plurality of medication doses 202*a* of the blister pack 202. In the fourth preferred embodiment, the blister pack 202 has a generally disc-shaped configuration and is adhesively bonded to the blister disc 230. The blister disc 230 also has a generally circular, disc-shape with the slots 230*a* positioned within and adjacent to a peripheral edge 230*b* of the blister disc 230. The slots 230*a* preferably have generally a similar cross-sectional shape as the hole 220*a* and individual medication doses 202*a*. The blister pack 202 is preferably fixed to the blister disc 230 such that the individual medication doses 202*a* are positioned immediately above and adjacent to the slots 230*a*. Accordingly, when a force is applied to the blister pack 202 at one of the medication doses 202*a*, the individual medication dose 202*a* is urged out of the blister pack 202 and through the respective slot 230*a*.

In the fourth preferred embodiment, a post (not shown) extends generally perpendicularly from the tray 220 and is positioned generally at the center of the tray 220. The blister disc 230 is rotatably mounted to the post and is rotatable about a rotation axis 250. One having ordinary skill in the art will realize that the blister disc 230 is not limited to being rotatably mounted to the tray 220 on a post or to the inclusion of the blister disc 230. For example, the blister pack 202 may be rotatably mounted directly to the tray 220 in a generally circular groove (not shown) on the tray 220 that slidably engages a peripheral edge 202*b* of the blister pack 202

The fourth preferred embodiment further includes a disc knob 260 that is removably mountable to the post. The disc knob 260 is mounted to a distal end of the post 240 when the blister disc 230 is mounted to the tray 220 to rotatably secure the blister disc 230 on the tray 220. The disc knob 260 removably secures the blister disc 230 to the tray 220 through a releasable force fit with the post. Accordingly, the disc knob 260 removably and rotatably secures the blister disc 230 to the tray 220. One having ordinary skill in the art will realize that the disc knob 260 is not required for successful use of the blister disc 230 and the blister disc 230 may be secured to the post or another component of the tray 220 such that the blister disc 230 is rotatable relative to the tray 220.

The fourth preferred embodiment also includes an alignment indicator 270 located on an exposed face of the tray 220 adjacent the hole 220*a*. The alignment indicator 270 provides an indication to a user regarding when one of the individual medication doses 202*a* is aligned with the hole 220*a* such that a force applied to the individual medication dose 202*a* toward the tray 220 urges the individual medication dose 202*a* through the blister pack 202 and the hole 220*a*. The hole 220*a* is covered by the blister pack 202 when the blister pack 202 is mounted to the tray 220. The alignment indicator 270 is visible on the exposed face adjacent the peripheral edge 202*b* when the blister pack 202 is mounted to the tray 220. In the most preferred embodiment, the individual medication doses 202*a* are aligned with the corresponding slots 230*a* in the blister disc 230. Further, when one of the individual medication doses 202*a* is aligned with the alignment indicator 270, the corresponding slot 230*a* is aligned with the hole 220*a*.

The tray 220 of the fourth preferred embodiment may include an information panel 222 on its face that may provide written information or instructions for a user when the tray 220 is in the exposed position. For example, the information panel 222 may include directions for use, ingredients, dosage or other instructions related to the medication doses 202*a*. However, the information panel 222 is not limiting and may be eliminated or expanded depending upon the specific application of the tray 220.

In operation, the generally disc-shaped blister pack 202 is adhesively bonded to the blister disc 230 and the blister disc 230 is rotatably mounted to the tray 220. The disc knob 260 is mounted to the tray 220, thereby removably and rotatably securing the blister disc 230 to the tray 220. The blister disc 230 and attached blister pack 202 may be rotated about the rotation axis 250 to selectively align individual medication doses 202*a* and corresponding slots 230*a* with the alignment indicator 270 depending upon the rotational orientation of the blister pack 202 and blister disc 230. When a predetermined medication dose 202 is aligned with the alignment indicator 270, a force is applied to the individual medication dose 202*a* that is aligned with the alignment indicator 270 toward the tray 220, thereby urging the individual medication dose 202*a* through the blister pack 202, the slot 230*a* and the hole 220*a*. A user may position their hand on an opposite side of the tray 220 from the exposed face such that the individual medication dose 202*a* falls into their hand when released from the blister pack 202. When the individual medication dose 202*a* is released from the blister pack 202, the blister disc 230 may be rotated such that another individual medication dose 202*a* and corresponding slot 230*a* is aligned with the hole 220*a*. A force may again be applied to urge the second individual medication dose 202*a* from the blister pack 202. Each individual medication dose 202*a* may be associated with a specific medication, for example, daily doses, weekly doses or monthly doses. Cycle indicators (not shown) may also be associated with the individual medication doses 202*a* to indicate the particular day, week, month, etc. during which the individual medication dose 202*a* should be taken. Accordingly, the preferred tray 220 conveniently stores the individual medication doses 202*a* and provides an indication to the patient if an individual medication dose 202*a* has been missed or if the patient should take an individual medication dose 202*a*.

Those skilled in the art will appreciate that changes could be made to the embodiments described above without departing from the broad inventive concept thereof. By way of example, the above-described child-resistant containers may be combined and adapted into a plurality of various configurations employing features from the various embodiments in a number of different ways without departing from the spirit and scope of the present application. For example, a child-resistant container could be constructed including the child-resistant container 110 of the second preferred embodiment that includes at least one tray 140 from the third preferred embodiment and a tray 220 including the rotatable blister disc 240 of the fourth preferred embodiment. It is understood, therefore, that this invention is not limited to the particular embodiments disclosed, but it is intended to cover modifications within the spirit and scope of the present invention as defined by the appended claims.

I claim:

1. A child-resistant container for holding at least one item, the container comprising:

a housing having upper and lower walls;

a first tray being pivotally mounted to the housing on a pivot axis for movement between a retracted position in which the first tray is positioned in the housing and an exposed position in which the first tray extends from the housing;

a second tray being pivotally mounted to the housing for movement between a retracted position in which the second tray is positioned in the housing and an exposed position in which the second tray extends from the housing, the first and second trays adapted for holding the at least one item; and a common locking mechanism including a flexible tab integral with the upper wall of the housing, the common locking mechanism releasably locking the first and second trays in the retracted position;

a first blister pack and a second blister pack, the first blister pack being mounted on the first tray and the second blister pack being mounted on the second tray, the first and second blister packs being inaccessible when the first and second trays are in the retracted positions, respectively.

2. The child-resistant container of claim 1 wherein the common locking mechanism is mounted to the housing and releasably locks the first tray and the second tray in the retracted positions.

3. The child-resistant container of claim 1 wherein the first and second trays each include an individual locking mechanism, the individual locking mechanisms being releasably engageable with the housing, the first and second trays being releasably locked in the retracted position by the common locking mechanism and the individual locking mechanisms, the first and second trays only being movable from the retracted position to the exposed position upon simultaneously releasing the common locking mechanism and the respective individual locking mechanism.

4. The child-resistant container of claim 1 further comprising:

one or more supplemental trays being pivotally mounted to the housing on the pivot axis, the one or more supplemental trays being separate from the first and second trays, each of the supplemental trays being pivotable between retracted and exposed positions, the common locking mechanism being mounted to the housing and releasably maintaining the supplemental trays in the retracted position, the one or more supplemental trays each including an individual locking mechanism that releasably engages the housing when each of the supplemental trays are in the retracted position.

5. The child-resistant container of claim 4 wherein one of the first, second and supplemental trays are moveable from the retracted position by application of a release force to the common locking mechanism and a depression force to the respective individual locking mechanism.

6. The child-resistant container of claim 1 wherein the second tray is pivotally mounted to the housing on the pivot axis.

7. The child-resistant container of claim 6 further comprising:

one or more supplemental trays being pivotally mounted to the housing on the pivot axis, the one or more supplemental trays being pivotable between a retracted position, wherein the one or more supplemental trays are positioned within the housing and an exposed position, wherein the one or more supplemental trays are exposed from the housing, the first tray, the second tray and the one or more supplemental trays being engaged by and releasably locked in the retracted position by at least the common locking mechanism.

8. A child-resistant container for holding at least one item, the container comprising:

a housing having upper and lower walls;

a first tray being pivotally mounted to the housing on a pivot axis for movement between a retracted position in which the first tray is positioned in the housing between the upper and lower walls and an exposed position in which the first tray extends from the housing;

a second tray being pivotally mounted to the housing on the pivot axis for movement between a retracted position in which the second tray is positioned in the housing between the upper and lower walls and an exposed position in which the second tray extends from the housing, the first and second trays being stacked in the housing when the first and second trays are in the retracted positions; and a common locking mechanism mounted to the housing and biased towards a locking position, the common locking mechanism includes a flexible upper tab integral with the upper wall of the housing, a flexible lower tab integral with the lower wall of the housing and a push rod mounted to the upper or lower tabs.

9. The child-resistant container of claim 8 further comprising:

the common locking mechanism releasably locking the first and second trays in the retracted positions; and an individual locking mechanism mounted to each of the first and second trays and releasably engaging the housing when the respective first and second trays are in the retracted position.

10. The child-resistant container of claim 8 wherein the at least one item is comprised of a first blister pack and a second blister pack, the first blister pack storing medication for a first time period and the second blister pack storing medication for a second time period, the first blister pack being removably mounted to the first tray and the second blister pack being removably mounted to the second tray.

11. A container for holding at least one blister pack therein, the container comprising:

a housing having upper and lower walls; and a tray being pivotally mounted to the housing for movement between a retracted position in which the tray is positioned in the housing and an exposed position in which the tray extends from the housing, the tray including a hole therein and being pivotal on a plane that is generally parallel to the upper and lower walls, the tray lying in a plane generally parallel to the upper and lower walls, the blister pack including a plurality of medication doses and being rotatably mounted to the tray such that one of the plurality of medication doses selectively aligns with the hole depending upon a rotational orientation of the blister pack.

12. The container of claim 11 further comprising:

a blister disc being removably and rotatably mountable to the tray, the blister pack being fixed to the blister disc, the blister disc including a plurality of slots corresponding to the plurality of medication doses.

13. The container of claim 12 further comprising:

a post extending generally perpendicularly from the tray, the blister disc being rotatably mounted on the post; and a disc knob removably mountable to the post, the disc knob being mounted to a distal end of the post when the blister disc is mounted to the tray to rotatably secure the blister disc on the tray.

14. The container of claim 12 wherein the blister pack is adhesively bonded to the blister disc.

15. The container of claim 11 further comprising:

a blister disc rotatably secured to the tray, the blister disc including a plurality of slots, the blister pack being mounted to the blister disc, the plurality of medication doses being aligned with the plurality of slots.

16. The container of claim 11 further comprising:

an alignment indicator located on an exposed face of the tray adjacent the hole, the blister pack having a generally disc-shape with a peripheral edge, the hole being covered by the blister pack when the blister pack is mounted to the tray, the alignment indicator being visible on the exposed face adjacent the peripheral edge when the blister pack is mounted to the tray.

17. The container of claim 11 further comprising:

a second locking mechanism movably mounted to the upper wall, the second locking mechanism being movable between a locking position and a release position, the second locking mechanism engaging and locking the tray within the housing when the tray is in the retracted position and the second locking mechanism is in the locking position.

18. The container of claim 17 wherein the tray is pivotally mounted to the housing and includes a cam surface and a shoulder, the cam surface moving the second locking mechanism from the locking position to the release position as the tray pivots from the exposed position toward the retracted position, the second locking mechanism engaging the shoulder when the tray is in the retracted position.

* * * * *